US005164097A

United States Patent [19]

Wang et al.

[11] Patent Number: 5,164,097

[45] Date of Patent: Nov. 17, 1992

[54] NOZZLE ASSEMBLY DESIGN FOR A CONTINUOUS ALLOY PRODUCTION PROCESS AND METHOD FOR MAKING SAID NOZZLE

[75] Inventors: Hsin-Pang Wang, Rexford; Erin M. Perry, Scotia, both of N.Y.; Yuan Pang, North Reading, Mass.

[73] Assignee: General Electric Company, Schenectady, N.Y.

[21] Appl. No.: 649,632

[22] Filed: Feb. 1, 1991

[51] Int. Cl.[5] ..... H05B 7/20

[52] U.S. Cl. ..... 222/590; 222/592; 266/236

[58] Field of Search ..... 266/236, 275, 45; 432/262, 263, 265; 222/590, 591, 597, 592

[56] References Cited

U.S. PATENT DOCUMENTS

| | | | |
|---|---|---|---|
| 3,435,992 | 4/1969 | Tisdale et al. | 266/236 |
| 4,345,467 | 8/1982 | Carlson | 222/595 |
| 4,583,717 | 4/1986 | Hasegawa et al. | 266/44 |
| 4,654,858 | 3/1987 | Rowe | 222/591 |
| 4,951,929 | 8/1990 | Schwarz et al. | 222/590 |
| 5,060,914 | 10/1991 | Wang et al. | 266/236 |

OTHER PUBLICATIONS

H. P. Wang et al., "Criteria for Achieving a Stable Solidified Layer Inside a Nozzle Using Integral Solutions", General Electric Corporate Research and Development Report No. 88, CRD 288, Oct. 1988.

H. P. Wang et al., "Formation and Growth of the Solidified Layer During Filling in the Investment Casting Process with an Application for Titanium Casting", General Electric Corporate Research and Development Report No. 88, CRD 023, Jun. 1988.

*Primary Examiner*—Scott Kastler

*Attorney, Agent, or Firm*—James R. McDaniel; James C. Davis, Jr.; Paul R. Webb, II

[57] ABSTRACT

A nozzle assembly design and a method for making the nozzle assembly, as well as a method for controlling a continuous skull nozzle process employing the nozzle assembly are provided wherein the cooling heat transfer coefficient at the nozzle is increased to maintain a steady-state solidified layer of a noncontaminating liner material, the cooling heat transfer coefficient being increased by reducing the contact resistance between a nozzle outer wall member and an inner liner made of the noncontaminating material, the reduction in contact resistance being achieved by shrink-fitting the nozzle outer wall member around the inner liner to increase the contact pressure between those members.

10 Claims, 4 Drawing Sheets

NOZZLE ASSEMBLY DESIGN FOR A CONTINUOUS ALLOY PRODUCTION PROCESS AND METHOD FOR MAKING SAID NOZZLE

BACKGROUND OF THE INVENTION 1. Field of the Invention

The present invention relates to a design for a nozzle and method of making the nozzle for use in an alloy production process, and particularly in processing non-contaminated molten titanium or titanium alloys.

2. Description of Related Art

It is widely recognized that one of the most important and urgent areas of materials research in the coming decade is the advancement of materials processing technology for a new generation of materials including metals and metal alloys. As an example, eliminating or substantially reducing the material impurities and eliminating or substantially reducing the presence of defects in fabricated parts or components are considered the major bottlenecks in improving the quality of the high performance aircraft engines to be built in this decade and beyond.

Efforts have heretofore concentrated on producing high quality metal powders to be employed in the fabrication of components, and the concentration on production of high quality powders from which components may be made is regarded as a major step in making "clean" materials for parts or components. The production of titanium and/or titanium alloys in powder or ingot form is of special significance in the aircraft engine field, due to the importance of the titanium and its alloys in designing and producing improved engine components. Notwithstanding the effort expended in developing processes or methods to produce high quality metal powders, a serious problem persists with respect to the production of high quality titanium and titanium alloys in that the high level of chemical reactivity of liquid titanium yields or tends to yield unacceptable levels of impurities in the intermediate forms, such as powders, or in the end product.

Because of the high reactivity of liquid titanium, the melting of the titanium or Ti alloy and discharging of the liquid titanium or Ti alloy are generally done in a technique known in the art as cold hearth or skull melting. An example of this technique is described in U.S. Pat. No. 4,654,858, issued to Rowe, and assigned to the assignee of the present application. Other skull melting configurations have also been disclosed in the art, and all of these may be characterized as having a crucible which retains the molten titanium, the crucible being made of a material other than titanium, and, in the "bottom pouring" embodiments, a discharge nozzle, also likely to be made of a material other than titanium. The skull melting technique attempts to avoid the problem of a reaction occurring between the liquid titanium and the crucible and nozzle materials by developing a skull of solid titanium covering the internal surfaces of the crucible and nozzle. The term "continuous skull nozzle process" will be used herein to refer to processes of this type in general.

While continuous skull nozzle processes have been in use in the art for a number of years, problems remain in such processes, particularly those in which-an elongated bottom discharge nozzle is employed (as compared with an orifice as depicted in the above-identified '858 patent), in that the formation and control of a stable skull inside the nozzle has proven to be a major hurdle in the development of consistent, dependable processes for melting and discharging the liquid metal from the crucible. The two principal problems experienced with skull formation in the nozzle are skull "freeze-off" and skull "melt-away". Freeze-off of the skull prevents the continued flow of the liquid metal out of the crucible to a further apparatus, such as a melt spinning device or continuous ingot casting device. Melt-away of the skull leaves the nozzle material exposed to react with the liquid titanium or alloy, which is likely to cause rapid deterioration of the nozzle by way of either chemical reaction or physical erosion, resulting in contamination of the liquid metal by impurities from the nozzle.

Prior attempts to control skull freeze-off or otherwise stabilize the skull geometry in the nozzle have all suffered from disadvantages which have ultimately rendered the proposed solutions ineffective, impractical, and in some instances, undesirable. In one such proposed solution, local induction heating applied to the skull at the nozzle was attempted as a means for preventing nozzle freeze-off from occurring. This approach proved to be ineffective at providing the necessary heat penetration required for maintaining a molten stream at the center of the nozzle, due to the skin effect which concentrates the heat generated at the outer portions of the nozzle and skull. The skin effect of the induction heating actually has a counterproductive effect in that most of the heat generation is concentrated at the outer skin, where a layer of solidified skull is required to be maintained.

The concept of a magnetic levitation nozzle has been propounded as an alternative approach to providing a physical crucible and nozzle structure, thereby eliminating contact between the containment or confinement means and the liquid titanium or alloy thereby preventing any chemical reaction from taking place. Because of the limited strength of the magnetic force, the potential for replacing the skull crucible and nozzle with a levitation nozzle, in view of the current level of technology, shows almost no promise.

The levitation nozzle approach has been proposed for use on a more limited basis to confine the melt stream only. In this approach, an induction coil would be used to confine the melt stream by generating a magnetic field to induce a thin layer of "body force" on the surface of the melt stream, the force having substantially the same effect as creating a positive hydrostatic pressure at the melt stream. The purpose of this type of levitation confinement is to control the flow rate and diameter of the liquid metal melt stream, without specifically dealing with the problem of maintaining a stable skull geometry in the nozzle.

Even in this more limited approach the levitation nozzle is unattractive due to problems intrinsic to the design of the induction coil, and due to problems in the application of this technology to confining the melt stream, such as the alignment of the coil, the stability of the induced current, the electromagnetic field interference and coupling, the complicated coil design, and problems with melt stability, asymmetry and splash. Further, since a crucible and nozzle would still be fundamental components in a system employing levitation to control the diameter of the melt stream, the complicated coupling and interaction between the levitation nozzle and the overall system would require tremendous experimental effort to validate the concept. Simplified experiments are not likely to adequately address the interactions among the levitation force, the nozzle size, and the formation, growth and control of the skull.

One proposed solution to achieving a desired steady-state solidified skull at the nozzle region in a continuous skull nozzle process has been set forth in copending U.S. patent application Ser. No. 07/552,980, filed Jul. 16, 1990, and assigned to the assignee of the present application. That application is hereby incorporated by reference. In that application, a systematic investigation of the continuous skull nozzle process was undertaken, and a process window was identified or defined such that a control strategy could be implemented so as to maintain a steady-state solidified skull in the nozzle region, which would not be subject to freeze-off or melt-away of the skull. A method for controlling the molten metal flow using a pressure differential between the interior and exterior of the crucible is proposed in that application as a means for governing the process to maintain operation within the defined process window.

Even with the process window approach in hand, a major hurdle is present in continuous skull nozzle processing in that the flow radius at the critical nozzle region will generally be too small to allow a stable solidified layer to be formed and maintained unless the cooling at the nozzle region is significant. No solution to this particular aspect of the continuous skull nozzle process has heretofore been propounded which would readily enable operation of the process within the defined process window resulting in the maintenance of a steady-state solidified skull.

It is therefore a principal object of the present invention to provide a design for a nozzle assembly which will allow suitable process controls to be employed for maintaining a stable solidified skull layer inside the nozzle.

It is another important object of the present invention to provide a method for constructing a nozzle which will permit operation of the process comfortably within the process window for maintaining a stable solidified skull layer inside the nozzle.

SUMMARY OF THE INVENTION

The above and other objects of the present invention are accomplished by providing a nozzle having an outer wall comprising a material having a relatively high thermal conductivity, such as copper, and an inner liner around which the outer wall is shrink fitted, the inner liner being of a material which is noncontaminating to the molten metal being processed, and preferably being a titanium tube material in the instances where a titanium material is being processed. The titanium will, in effect, act as a pre-solidified skull layer in this configuration.

The shrink fitting of the outer wall to the inner liner produces increased contact pressure between the liner and the outer wall as compared with the contact pressure produced by merely building up a solidified layer or skull of titanium, or another metal being processed, against an inner surface of a nozzle. The increase in contact pressure produces a corresponding decrease in contact resistance, or resistance to heat transfer, between or across the two materials. This contact resistance is a large component of the overall heat transfer coefficient of the nozzle during operation of the casting process.

As noted previously in the specification, one difficulty in operating a continuous skull nozzle process within a defined process window for maintaining a steady-state solidified skull is achieving adequate heat transfer in the nozzle region to carry a sufficient amount of heat away from the nozzle to maintain the solidified skull layer. The difficulty in obtaining adequate heat transfer is present primarily due to limitations on the size of the flow radius in the nozzle imposed by the process. It has been determined in accordance with the present invention that the reduction in contact resistance brought about by shrink fitting the outer wall of the nozzle against a pre-solidified skull liner can increase the overall heat transfer coefficient of the nozzle structure to a value at which the continuous skull nozzle process can readily operate within the defined process window.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the invention, taken in conjunction with the accompanying drawings wherein like reference characters represent like parts through the several views.

DETAILED DESCRIPTION OF THE INVENTION

Figure 1:
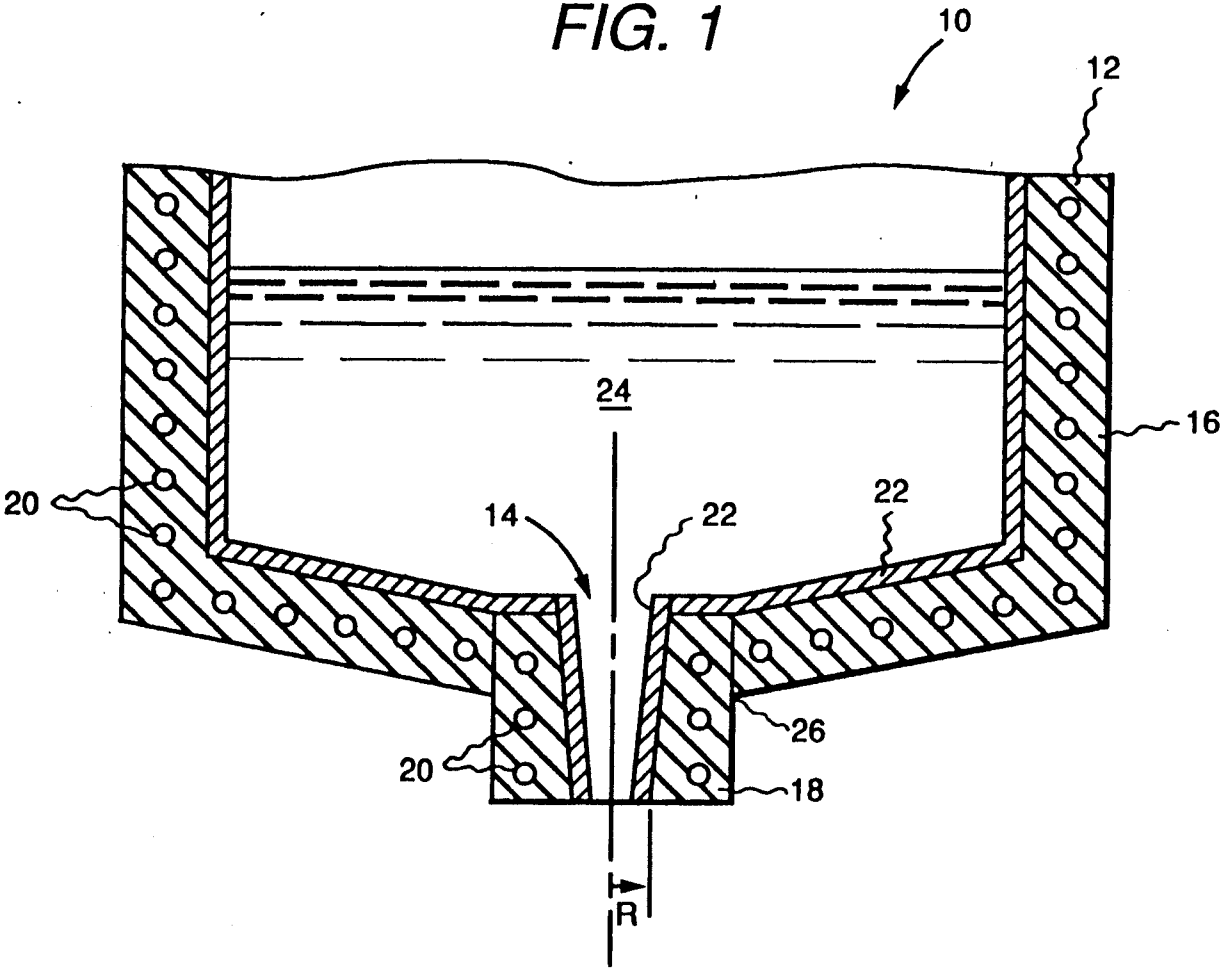
FIG. 1 is a substantially schematic cross-sectional view of a lower portion of a cold hearth crucible and nozzle configuration suitable for use in a continuous skull nozzle process.

Referring initially to FIG. 1, an apparatus 10 is depicted in substantially schematic form which comprises a crucible or tundish 12 and bottom nozzle 14, the apparatus being employed as a receptacle for use in a continuous skull nozzle process for melting and discharging liquid titanium, a liquid titanium alloy, or another metal or metal alloy. While the remainder of the detailed description will refer primarily to the processing of titanium, it is to be recognized that the invention is equally applicable to continuous skull nozzle processes involving the processing of titanium alloys and other metals and metal alloys.

The crucible wall 16 and nozzle outer wall member 18 are preferably made of a material, such as copper, having a relatively high thermal conductivity and are provided with channels 20 through which a coolant is passed in order to provide increased heat transfer away from the crucible and nozzle walls. It is to be noted that only a lower portion of the crucible 12 is depicted in FIG. 1, and that the crucible wall 16 will preferably extend upwardly in a hollow cylindrical configuration or another suitable configuration to create a sufficient internal volume for holding a desired quantity of a molten alloy for a given process. Nozzle outer wall member 18 is joined to a corresponding opening 26 in the bottom of crucible wall 16 by suitable assembly mechanisms.

Particularly in the case of titanium processing, the process referred to herein as a continuous skull nozzle process relies on the presence of a skull or layer 22 of solidified titanium to isolate the crucible and nozzle walls 16, 18 from the molten titanium 24 which is to be discharged through the bottom nozzle 14 for further processing. As indicated previously, the titanium in liquid form has such a high chemical reactivity that the titanium is almost certain to pick up impurities or contaminants, in the form of dissolved crucible wall material, such as dissolved copper, in the absence of this skull 22. Prior processes have employed such a skull, however, such processes have not been capable of consistently forming and controlling a stable skull inside the nozzle, and such processes have commonly experienced the freeze-off or melt-away conditions previously described and the corresponding disruptions to the process.

The present invention recognizes that the growth or decay of the solidified skull inside the nozzle is a very complex function involving many parameters, including the properties of the material being processed, the geometry of the overall apparatus and of the nozzle, and the process conditions. Because the maintenance of a stable solidified skull involves control of a phase change interface, there are complex interactions among many parameters, and attempting to attach a particular significance to the influence of one or more individual parameters on the process and skull formation can be confusing and misleading. The invention disclosed in copending application Ser. No. 07/552,980, filed Jul. 16, 1990, which is assigned to the assignee of the present application and incorporated herein by reference, presents a systematic scheme of analysis to evaluate the parametric relations among the several parameters to define a process window, inside of which the continuous skull nozzle process may be carried out, wherein a stable skull geometry is maintained which will not be susceptible to the problem of skull freeze-off or melt-away.

The method of defining a process window takes into account various material properties, namely, the thermal conductivity of the material, density, heat capacity, phase change temperature, and latent heat. The method also takes into account process conditions, namely, an inner and outer heat transfer coefficient, the melt superheat, and the cooling water temperature. The inner and outer heat transfer coefficients are functions of the Reynolds numbers and Prandtl numbers of the melt and coolant flows, and the heat transfer coefficients may be determined accordingly in each specific process.

Figure 2:
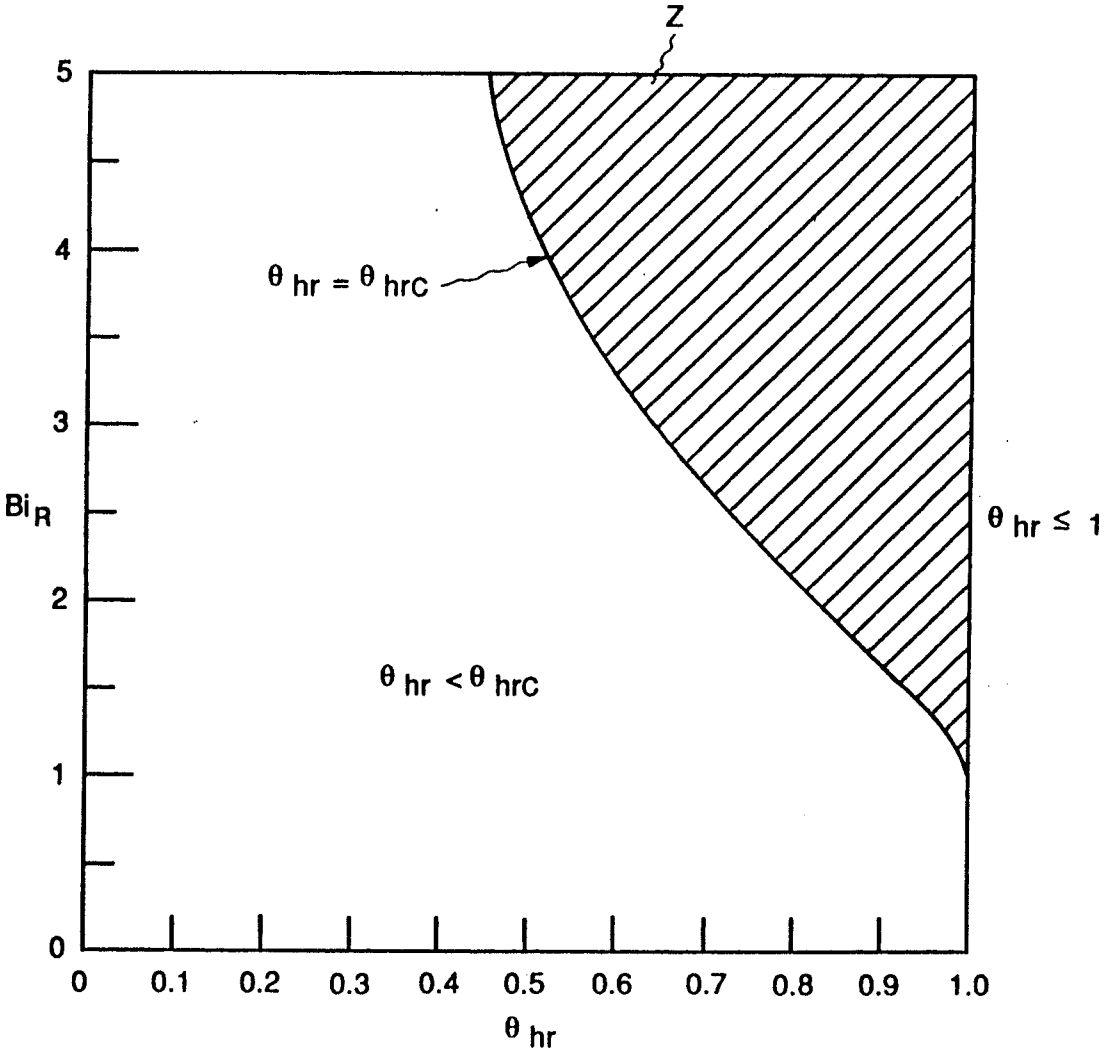
FIG. 2 is a graphical representation of a generic process window for achieving a steady-state solidified skull layer in a nozzle during a continuous skull nozzle process.

FIG. 2 displays a process window Z wherein the shaded or hatched area represents the range of nozzle sizes in terms of the dimensionless nozzle size $Bi_R$ and the range of processing conditions, represented by the dimensionless parameter $\theta_{hr}$, consisting of a heat transfer coefficient ratio and a superheat temperature parameter, in which a stable skull will be maintained in the process. The steps involved in the derivation of this generic process window are disclosed in the aforementioned Application Ser. No. 552,980, which application is herein incorporated by reference.

The dimensionless parameters employed in FIG. 2 are defined in the above-noted application, and for convenience are repeated below. It should be noted that the parameters appearing in the definitional equations below represent the following: $h_1$ is an "outer" heat transfer coefficient representative of the heat transfer coefficient at the boundary between the solidified layer or skull 22 and an inner surface of the nozzle outer wall 18; $h_2$ is an "inner" heat transfer coefficient at the boundary between the liquid phase metal or metal alloy and the solid phase (skull) metal or metal alloy; R is the radius of the opening in nozzle outer wall 18, measured from a centerline to the inner surface of the nozzle outer wall; k is the thermal conductivity of the solid phase of the metal or metal alloy being processed; $T_{sup}$ is the superheat temperature in the liquid metal or metal alloy; $T_a$ is the ambient temperature; and $T_f$ is the liquid-solid phase change temperature for the metal or metal alloy being processed.

The dimensionless nozzle size $Bi_R$ of FIG. 2 is defined as:

$$Bi_R = \frac{h_1 R}{k}. \tag{1}$$

The dimensionless process condition parameter $\theta_{hr}$ is defined as:

$$\theta_{hr} = \frac{h_2}{h_1}(\theta_{sup} - 1), \tag{2}$$

wherein $\theta_{sup}$, a dimensionless superheat temperature, itself is defined as:

$$\theta_{sup} = \frac{T_{sup} - T_a}{T_f - T_a}. \tag{3}$$

As can be seen in FIG. 2, in order to operate the process within the process window, two criteria must be satisfied. A first criterion is that the dimensionless nozzle parameter $Bi_R$ must be greater than one (1), and the second is that the dimensionless process parameter, $\theta_{hr}$, must be a value less than one (1) and must be greater than what is termed a critical process parameter $\theta_{hrC}$, defined as follows:

$$\theta_{hrC} = \frac{1}{Bi_{fC}}, \tag{4}$$

wherein $Bi_{fC}$ is a critical value of $Bi_f$, a dimensionless Biot number defining the dimensionless solid/liquid phase change line as set forth below:

$$Bi_f = \frac{h_1 R_f}{k}, \tag{5}$$

wherein $R_f$ is the flow radius in the nozzle, measured from the centerline of the nozzle to the liquid/solid interface In working toward developing control schemes to conduct the process within the defined process window, it was determined that meeting the first criterion noted above initially proved to be a fairly substantial obstacle to successfully carrying out the process. As seen in FIG. 1, the inner nozzle wall will generally be tapered inwardly toward the exit, resulting in the nozzle radius R being at its smallest value at the exit where the critical stability region exists. In looking to Equation (1) above, and considering the values of the thermal conductivity (k) of the Ti material, the value of a commonly employed size of nozzle radius (R) at the exit (on the order of 0.5 inch), and the value of a calculated cooling heat transfer coefficient based on a standard contact resistance between a titanium layer and a copper nozzle wall surface, the dimensionless nozzle parameter calculates out to a value much smaller than one, which violates the first criterion for operation within the process window. The term "standard contact resistance" is used to described the contact resistance resulting from the solidification of the titanium from a liquid state onto the inner surface of the copper nozzle, with no special effort being employed to increase contact pressure or otherwise decrease the contact resistance between the solidified titanium and the nozzle wall.

It will be recognized that, in attempting to bring $Bi_R$ up to a value greater than one, the thermal conductivity k of the titanium cannot generally be Changed, and one must therefore consider changing the values of the other parameters used in defining the value of $Bi_R$ in order to effect a change in the value of $Bi_R$. The range of nozzle sizes, and thus nozzle radii (R), is generally restricted in order for the nozzle to be capable of being used in atomization processes, wherein the molten material is discharged in a series of droplets of a predetermined size, as well as being capable of being used in processes in which a substantially continuous flow of the molten material is discharged. Increasing the nozzle radius size also has the effect of altering other basic processing parameters and conditions to the extent that the operation of the process must be essentially reformulated based on the new nozzle radius size. The most promising approach to increasing the parameter $Bi_R$ to a value greater than one was thus determined to be increasing the cooling heat transfer coefficient $h_1$.

Because the cooling heat transfer coefficient $h_1$ is also a parameter in the equation defining $\theta_{hr}$, which is the second criterion established by the process window, meeting that second criterion with the increased value of $h_1$ must also be taken into consideration. Increasing the cooling heat transfer coefficient $h_1$ as suggested above will bring about some decrease in the value of $\theta_{hr}$, in the absence of making other adjustments in the processing conditions. It will be recognized that very little can be done to affect the value of $\theta_{sup}$ in the equation defining $\theta_{hr}$ to account for the increase in the value of $h_1$. It was, however, determined in the development of the present invention that, even with the higher value of $h_1$ being dictated by the requirement to meet the first criterion, it would be possible, primarily by making an appropriate adjustment in the value of $h_2$, to operate the process in a manner such that the second criterion is also met. The internal heat transfer coefficient $h_2$ is mainly a function of the molten liquid metal flow rate, which can be properly controlled by, for example, the pressure differential method disclosed in copending Application Ser. No. 07/552,980. The value of $\theta_{hr}$ can thus be properly adjusted through adjustment of $h_2$ to satisfy the second criterion and maintain the process operating inside the process window.

The value of the cooling heat transfer coefficient, $h_1$, of the nozzle is a combined effect of the heat transfer of the cooling water passing through the channels 20 in the nozzle, the heat conduction of the nozzle, which has conventionally been made of copper, having a relatively high thermal conductivity, and the contact resistance between the copper nozzle and the solidified skull layer. Because the thermal resistance of the cooling water and of the copper nozzle were determined to be very small relative to the contact resistance, the inventors herein found that the most effective way to increase the cooling heat transfer coefficient was to reduce this contact resistance between the inner surface of the copper nozzle outer wall and the solidified titanium skull layer.

Figure 3:
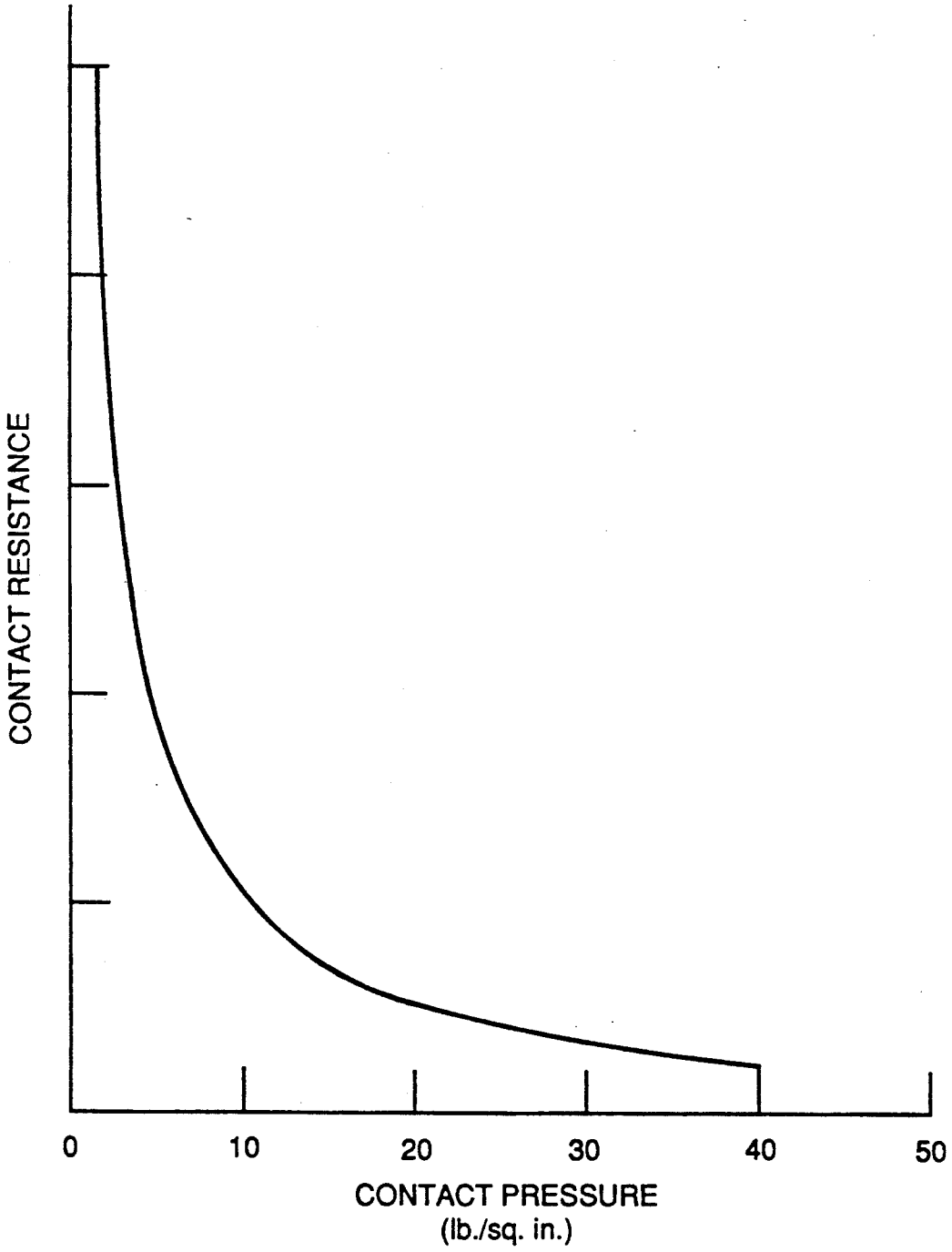
FIG. 3 is a graph showing a representative example of a decrease in contact resistance experienced as a function of contact pressure between two materials.

As can be seen in FIG. 3, as a general rule, the contact resistance between two materials is inversely proportional to the contact pressure between the materials. FIG. 3 is provided primarily to illustrate a representative example of the relationship between contact resistance and contact pressure. Other factors may play a role in the contact resistance between two materials, for example, the smoothness or finish of the surfaces which are placed in contact as well as the degree to which those surfaces correspond in geometry to one another. Although FIG. 3 is not intended to be directed to a specific example of materials in contact, the contact resistances experienced when using the materials of interest herein exhibit similar sharp drops starting at contact pressures of about 10 pounds per square inch, and continue dropping by significant amounts up through about 20–30 pounds per square inch. Contact pressures in excess of that further reduce the contact resistance, but a leveling of the curve is evident, and the reductions become marginal.

In prior processes, the skull layer has been formed on the outer wall member of the nozzle by simply fostering a buildup of solidified titanium on a bare inner surface of the outer wall member, or by starting with a nozzle completely frozen off by solidified titanium, and melting an inner part thereof to create a fluid passageway. In either approach, no substantial amount of residual stress, or contact pressure, will be present between the nozzle outer wall member and the solidified skull of titanium.

Figure 4A:
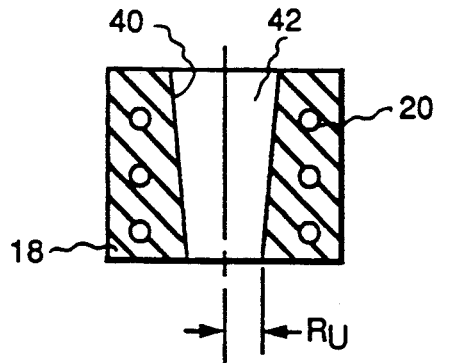
FIG. 4A–D are substantially schematic cross-sectional representations of the steps involved in producing a nozzle having a shrink-fit outer wall surrounding an inner liner in accordance with a preferred embodiment of the present invention.

Turning now to FIGS. 4A–D, a method for constructing a nozzle 14 in accordance with a preferred embodiment of the present invention and the resulting nozzle construction are depicted. It is the nozzle construction itself which effects an increase in the cooling heat transfer coefficient, $h_1$, over that resulting from merely building up a solidified skull on an inner surface of a nozzle. FIG. 4A depicts a cross section of the basic nozzle outer wall member 18, which is preferably made of copper or another metal having high thermal conductivity. The outer wall member 18 in FIG. 4A is shown to be of substantially annular shape having a tapered inner surface 40, and is representative of the size or diameter of the outer wall at room temperature. Coolant channels 20 are provided in the outer wall member 18 in a conventional manner, in order to assist in increasing heat transfer away from the nozzle.

Figure 4B:
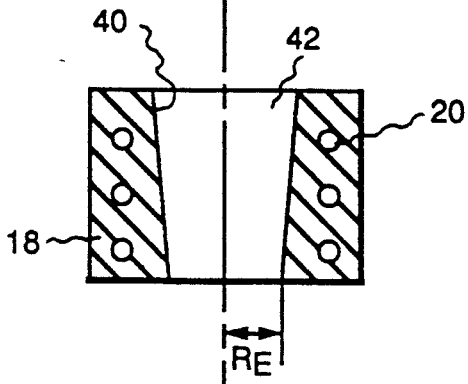

FIG. 4B depicts the same outer wall member 18 of the nozzle after it has been heated to an elevated temperature, whereby the wall member has undergone thermal expansion, primarily noticeable as an increase in the diameter of the annular member, as can be seen by comparing the distances, $R_U$ and $R_E$, which measure the distance between the inner surface 40 of the outer wall 18 and a centerline axis of the nozzle represented by the broken line in each of FIGS. 4A–D, before and after thermal expansion. It is preferred to heat the copper outer wall to a temperature of about 100° C., which will result in an increased diameter, measured at the inner surface 40, which will preferably be expanded to a size no more than one percent larger than the original, unexpanded size. The expansion shown in FIG. 4B is thus exaggerated for the purpose of clarity in the drawings.

It will be recognized that greater expansion of the outer wall member is possible with increased temperatures, however, as can be seen in FIG. 3, a contact pressure in excess of about 20–30 pounds per square inch provides relatively little improvement, or decrease, in contact resistance. The modest 1% expansion of the outer wall member and subsequent contraction will provide a contact pressure at least in this range and possibly higher.

Figure 4C:
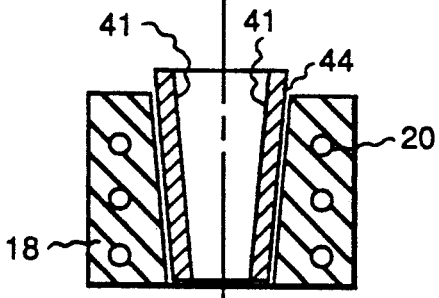

Turning now to FIG. 4C, in accordance with the method of the present invention, an inner liner 41, preferably made of titanium, is inserted into the opening 42 defined by the outer wall member 18 while the outer wall is in its elevated temperature, expanded condition. The titanium inner liner 41 is preferably not at an elevated temperature when it is inserted. The titanium inner liner 41 will have an outer surface 44 which has a complementary taper to the taper of the inner surface 40 of the outer wall 18. In more general terms it is preferred that the outer surface 44 of liner 41 and the inner surface 40 of the outer wall 18 have mating shapes. These surfaces, shown in the preferred embodiment as forming truncated cone shapes, may be finish ground to more closely match the contact surfaces.

Figure 4D:
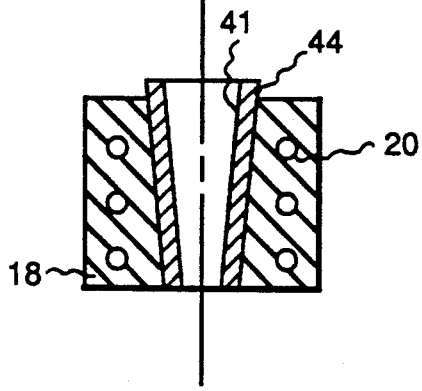

FIG. 4D shows the final configuration of the nozzle 14, wherein the copper outer wall 18 has been permitted to cool down to room temperature, and in cooling down, contracts back toward its original size. As the outer wall 18 contracts, its inner surface 40 comes into contact with the outer surface 44 of the inner liner or sleeve 41, thereby creating a shrink-fit between the outer wall 18 and inner liner 41. In the preferred embodiment, referring now to FIGS. 4C and 4D, the diameter of the outer surface 44 of the liner 41 at an unelevated temperature is preferably slightly larger than the original diameter of the opening 42 defined by the inner surface 40 in the outer wall 18 prior to the thermal expansion of the outer wall 18. In such a configuration, residual stresses between the materials will be generated. The outer wall will be attempting to return to its original dimensions, which it is prevented from doing by the inner liner 41. The inner liner 41 will be of sufficient strength to retain its shape while resisting the further contraction of the outer wall 18. The residual contractive stresses create a contact pressure between the outer wall 18 and the inner liner 41 which reduces the contact resistance in the nozzle assembly.

As noted previously, and as evidenced in FIG. 3, as the contact pressure increases (increased residual stress between the two members), particularly into the range of about 20–30 lb./sq.in., the contact resistance is greatly reduced, which results in an increased heat transfer coefficient across the boundary between the materials. The nozzle assembly described above will have a contact pressure of at least about 10 lb./sq.in., and preferably in the range between about 20–30 lb./sq.in., in order to provide the increased value of $h_1$.

As a further step in this method according to a preferred embodiment of the invention, the contact resistance between the outer wall member 18 and the inner liner 41 may be further reduced by carrying out the shrink-fitting of the outer wall member 18 onto the inner liner 41 in a helium gas environment. This further step recognizes that a certain amount of fluid from the environment in which the shrink-fit procedure is carried out will become trapped in the gap between the outer wall member 18 and the inner liner 41 in the final structure. Helium gas has a higher thermal conductivity as compared with, for example, the composition of air, made up largely of nitrogen and oxygen. Conducting the shrink-fitting of the outer wall member 18 to the liner 41 in a helium gas environment will have the effect that any gas which is trapped between the compounds will be helium gas as opposed to a less thermally conductive gas.

It is to be recognized that the inner liner 41 is selected to be made of a material which will not contaminate the molten material being processed so that the liner can operate as a pre-solidified skull layer in the continuous skull nozzle process. The process control strategy employed with this apparatus will thus not generally have to employ any special initialization parameters for building up any additional thickness of solidified titanium at the nozzle in order to meet the process window criteria for maintaining the steady-state skull in the nozzle region. Because the prestressing of the outer wall and liner of the nozzle provides the increase in the cooling heat transfer coefficient necessary to facilitate operation within the process window, it will be recognized that care must be taken to prevent any substantial melt-away of the liner 41 during start-up, shut-down, and operation of the process. This is of relatively minor concern, as the cooling fluid running through channels 20 keeps the copper outer wall member 18 at approximately room temperature, wherein heat can be readily transferred to the copper mass, keeping liner 41 in solidified form.

The foregoing description includes various details and particular features according to a preferred embodiment of the present invention, however, it is to be understood that this is for illustrative purposes only. Various modifications and adaptations may become apparent to those of ordinary skill in the art without departing from the spirit and scope of the present invention. Accordingly, the scope of the present invention is to be determined by reference to the appended claims.

What is claimed is:

1. A method for constructing a discharge nozzle to be used in a skull melting process comprising:

heating a copper outer wall member of said nozzle to a temperature sufficient to thermally expand said outer wall member;

inserting a titanium or titanium alloy inner liner into an opening defined by an inner surface of said outer wall member, an outer surface of said inner liner having a greater peripheral dimension than a corresponding dimension of said opening when said outer wall is in an unexpanded condition, said inner liner being made of a material which is compatible with a molten material to be discharged through said nozzle; and cooling said outer wall member to cause said outer wall member to contract into contact with said inner liner.

2. A method as recited in claim 1 wherein a shape of said outer surface of said inner linear corresponds substantially in geometry to a shape of said inner surface of said outer wall member.

3. A method as recited in claim 2 wherein said outer wall member and said inner liner are substantially annular in shape.

4. A method as recited in claim 3 wherein said outer wall member has cooling channels extending therethrough.

5. A method as recited in claim comprising the further step of attaching said outer wall member carrying said inner liner to a crucible.

6. A method as recited in claim 1 wherein said outer wall member is radially expanded to a size which is approximately 1% larger than an initial unexpanded size.

7. A method as recited in claim 1 wherein a contact pressure produced by said outer wall member contracting into contact with said inner liner is greater than about 10 pounds per square inch.

8. A method as recited in claim 1 wherein at least said cooling step is conducted in a helium gas environment to further improve the heat transfer between said inner linear and said outer wall member.

9. A method as recited in claim 8 wherein a shape of said outer surface of said inner liner corresponds substantially in geometry to a shape of said inner surface of said outer wall member.

10. A method as recited in claim 9 wherein said outer wall member and said inner liner are substantially annular in shape.

* * * * *